US008083114B1

(12) United States Patent
Steele et al.

(10) Patent No.: US 8,083,114 B1
(45) Date of Patent: Dec. 27, 2011

(54) TAPE DISPENSER WITH BLADE GUARD

(75) Inventors: Richard W. Steele, Traverse City, MI (US); Wendy H. Steele, Traverse City, MI (US)

(73) Assignee: Stexley-Brake, LLC, Traverse City, MI (US)

( * ) Notice: Subject to any disclaimer, the term of this patent is extended or adjusted under 35 U.S.C. 154(b) by 546 days.

(21) Appl. No.: 12/116,463

(22) Filed: May 7, 2008

Related U.S. Application Data

(63) Continuation-in-part of application No. 11/532,515, filed on Sep. 16, 2006, now abandoned.

(60) Provisional application No. 60/916,646, filed on May 8, 2007.

(51) Int. Cl.
*B44C 7/00* (2006.01)

(52) U.S. Cl. ..... 225/20; 225/46; 225/66; 30/285; 30/289

(58) Field of Classification Search ..... 225/19, 225/20, 44–46, 60, 61, 66; 30/285, 286, 30/289; 156/523, 527, 574, 577, 579
See application file for complete search history.

(56) References Cited

U.S. PATENT DOCUMENTS

| | | | | | |
|---|---|---|---|---|---|
| 2,790,609 | A * | 4/1957 | Hawthorne et al. | ..... | 225/26 |
| 3,725,182 | A * | 4/1973 | Regan | ..... | 156/527 |
| 5,024,362 | A * | 6/1991 | Karlsson | ..... | 225/20 |
| 5,075,976 | A * | 12/1991 | Young | ..... | 30/391 |
| 5,167,357 | A * | 12/1992 | Shih | ..... | 225/20 |
| 5,393,367 | A * | 2/1995 | Yu Chen | ..... | 156/523 |
| 5,849,144 | A | 12/1998 | Tang et al. | | |
| 5,906,705 | A | 5/1999 | Chung et al. | | |
| 6,145,722 | A * | 11/2000 | Behrens et al. | ..... | 225/42 |
| 6,634,402 | B2 | 10/2003 | Chen | | |
| 6,651,718 | B2 | 11/2003 | Hua | | |
| 6,662,844 | B2 * | 12/2003 | Huang | ..... | 156/527 |
| 6,789,594 | B1 * | 9/2004 | Yu Chen | ..... | 156/523 |
| 7,195,048 | B2 | 3/2007 | Wojtkun et al. | | |
| 7,383,868 | B1 * | 6/2008 | Huang | ..... | 156/527 |
| 7,712,507 | B2 * | 5/2010 | Huang | ..... | 156/527 |
| 2006/0169709 | A1 | 8/2006 | Bailey et al. | | |

* cited by examiner

*Primary Examiner* — Edward Landrum
(74) *Attorney, Agent, or Firm* — McGary Bair PC

(57) ABSTRACT

A tape dispenser of the type having a cutting blade mounted on the upper end of a cutting bar with a cutting bar face below and generally parallel to the blade and a blade guard slidably mounted on the cutting bar face for movement between blade-covering and blade-exposing positions. A spring tension element is positioned on the blade guard so that it tends to push a lower end of the blade guard away from the cutting bar face and to push an upper blade-covering end of the blade guard toward the cutting bar face when the blade guard is in the blade covering position.

10 Claims, 6 Drawing Sheets

TAPE DISPENSER WITH BLADE GUARD

CROSS-REFERENCE TO RELATED APPLICATIONS

This application is a continuation in part of U.S. patent application Ser. No. 11/532,515 filed Sep. 16, 2006, now abandoned and claims priority to U.S. Provisional Patent Application Ser. No. 60/916,646, filed May 8, 2007, all of which is incorporated herein by reference.

BACKGROUND OF THE INVENTION

1. Field of the Invention

The invention relates to tape dispensers of the type having cutting blades for severing heavy-duty tapes such as duct tape and shipping tape. In one of its aspect, the invention relates to a tape dispenser with a blade guard that is selectively movable to and from a blade covering position.

2. Description of Related Art

Tape dispensers with wide, sharp cutting blades are well known in the field of packaging and shipping. Shipping tape dispensers can be seen in common use in any package shipping facility or Post Office. These dispensers often have cutting blades on the order of two or three inches wide.

Co-pending U.S. patent application Ser. No. 11/532,515 discloses a tape dispenser suitable for duct tape and other wide, hard-to-tear tapes. This dispenser uses a wide cutting element or blade mounted on a supporting cutting bar with a large vertical face below the blade.

Many users of heavy-duty tape dispensers of the types listed above simply leave them lying around between uses, with the blade exposed. The duct tape dispenser in the '515 application partially addresses this issue with a storage bracket that conveniently keeps the dispenser secured on a wall or under a shelf.

SUMMARY OF THE INVENTION

According to the invention, a tape dispenser having a spool portion for dispensing a tape and a cutting portion that is adapted to cut tape fed from the spool portion has a blade guard slidably mounted on the cutting portion adjacent to the cutting blade for selective movement between blade-covering and blade-exposing positions In one embodiment, the blade guard and the cutting portion are configured to selectively maintain the blade guard in the blade covering and blade exposing positions.

In another embodiment, the cutting portion includes a cutting bar adjacent to the cutting blade and with a face extending downwardly from the cutting blade and the blade guard is slidably mounted to the face of the cutting bar.

In yet another embodiment, one of the blade guard and the cutting portion further includes at least one spring element in sliding tensioned contact with the other of the blade guard and the cutting portion.

In a preferred embodiment, the blade guard further includes the least one spring element. Preferably, the at least on spring element tends to push a lower end of the blade guard away from the cutting bar face and to push an upper blade-covering end of the blade guard toward the cutting bar face when the blade guard is in the blade covering position.

In another embodiment, the blade guard further comprises a grip for moving the blade guard between the blade-covering and blade-exposing positions and the grip is positioned at a lower end of the blade guard.

In a preferred embodiment, the cutting bar face has a slot and the blade guard comprises a T-shaped follower with a stem that extends through the slot and ears that are retained on a rear surface of the cutting bar behind the face for sliding movement of the blade guard on the cutting bar. Further, the cutting bar face includes a detent for receiving and relieving the at least one spring element when the blade guard is in the blade-exposing position.

In another embodiment, a releasable interlock between the blade guard and the cutting bar releasably maintains the blade guard in the blade-covering position. Preferably, the releasable lock comprises a shoulder on the rear surface of the cutting bar below and in registry with the ears on the blade guard follower when the blade guard is in the blade-covering position.

Further according to the invention, a tape dispenser adapted to rotatably house a roll of tape comprises two unitary sidewalls; a top wall portion extending axially between the sidewalls and connecting the sidewalls above the outer diameter of a roll of tape contained in the dispenser; a spool support extending axially between the sidewalls and connecting the sidewalls through a spool portion of a roll of tape contained in the dispenser; and a cutting bar extending axially between the sidewalls and connecting the sidewalls together at a forward end of the dispenser, the cutting bar mounting a cutting element for cutting tape and forming a tape retainer surface adjacent to the cutting element for adhesively securing a leading cut end of tape from a roll of tape contained in the dispenser subsequent to severing a leading portion of the tape from the cut end. The cutting bar is spaced circumferentially from a forward end of the top wall portion to define a tape-feed opening between the top wall portion and the cutting bar. The dispenser is radially split into two axially registering and rotationally mating halves that have rotationally mating locking structures on each of the top wall portion, the spool support, and the cutting bar that releasably interlock the mating halves together as the mating halves are rotated relative to each other.

In one embodiment, the dispenser further comprising a blade guard slidably mounted on the cutting bar adjacent to the cutting blade for selective movement between blade-covering and blade-exposing positions.

These and other features and advantages of the invention will become apparent from the detailed description below, in light of the accompanying drawings.

DESCRIPTION OF THE PREFERRED EMBODIMENT

Figure 1:
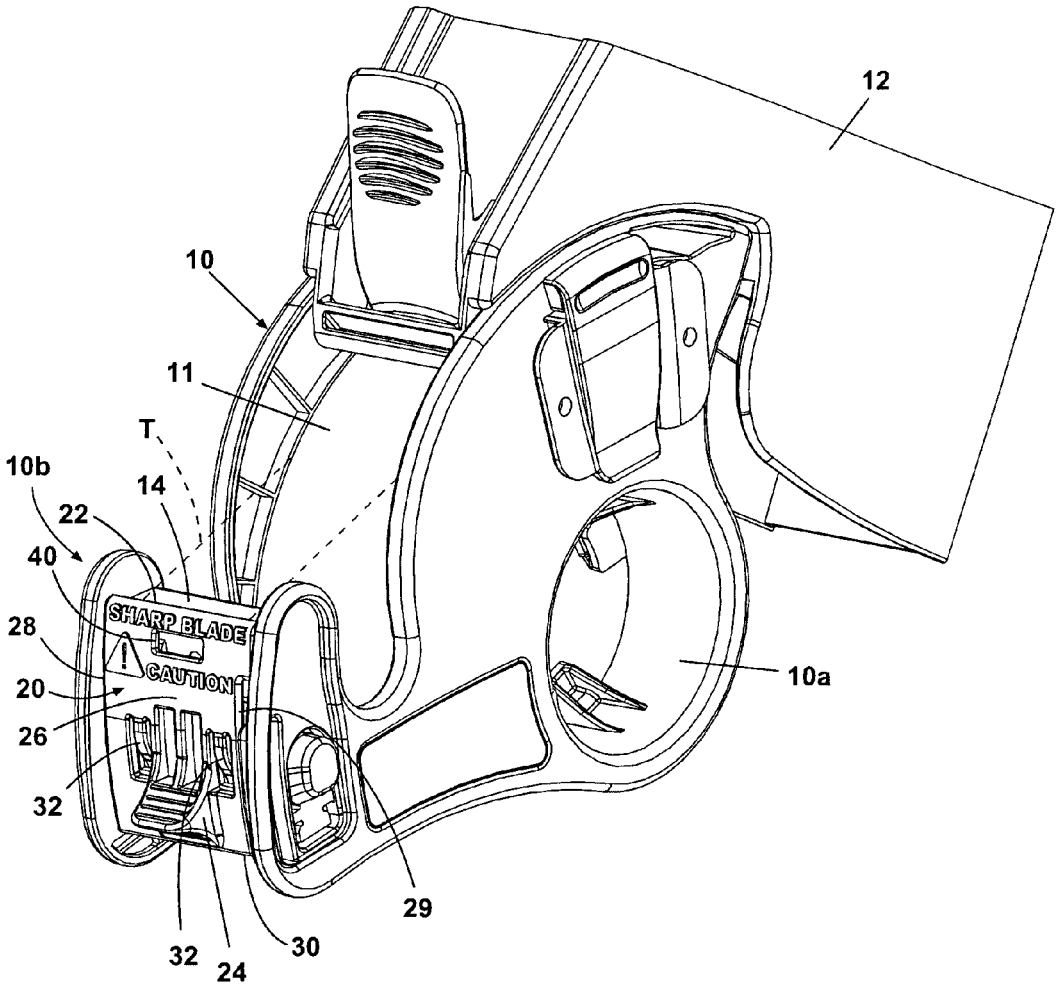
FIG. 1 is a front perspective view of a tape dispenser provided with a blade guard according to the present invention.
Figure 2:
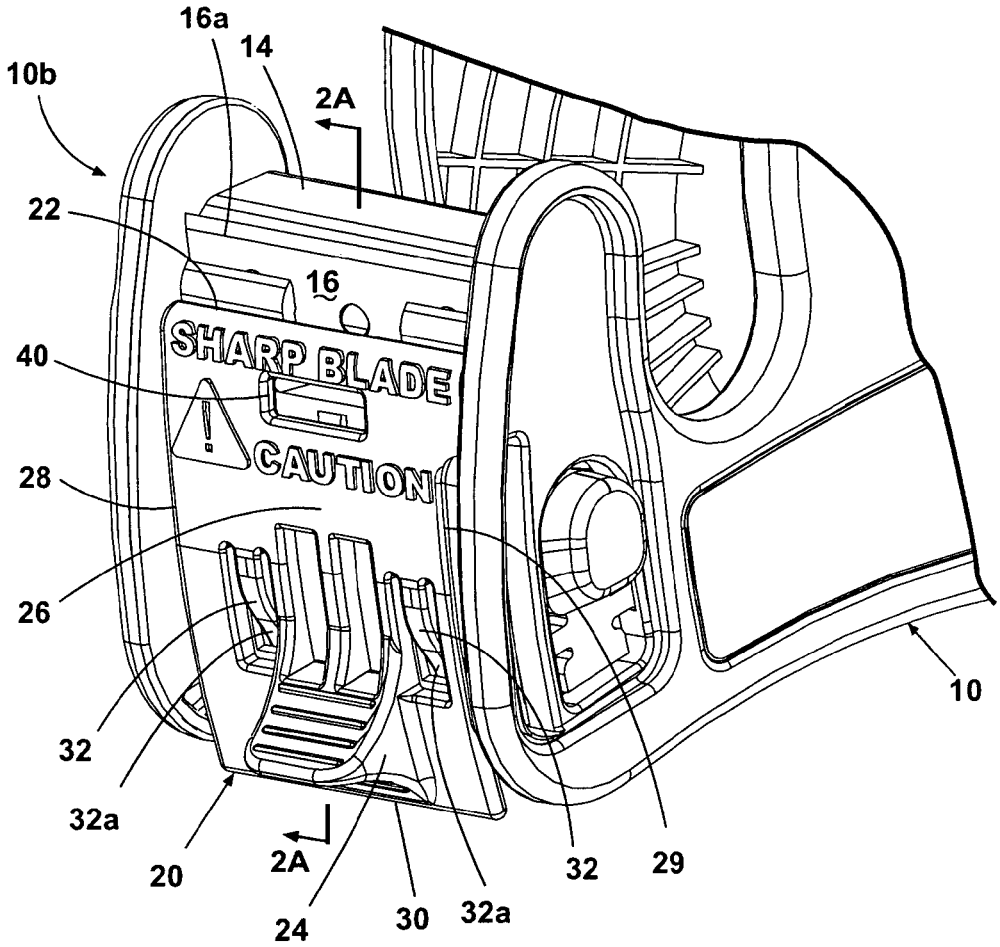
FIG. 2 is a detailed perspective view of the blade guard of FIG. 1, with the blade guard lowered to expose the cutting blade.

Referring first to FIGS. 1 and 2, a tape dispenser 10 as disclosed in U.S. patent application publication No. 2008/0067211, filed Sep. 16, 2006 and entitled "Duct Tape Dispenser with Holder", the disclosure of which is hereby incorporated by reference in its entirety is shown mounted on a wall bracket 12. Tape dispenser 10 has a frame that has a spool portion 10*a* and a cutting portion 10*b*. The cutting portion 10*b* includes a cutting bar 14 supporting a blade 16 for cutting heavy-duty tapes such as duct tape from a roll 11 rotatably mounted on a spool portion 10*a* of the dispenser 10, and fed sticky side down across a cutting edge 16*a* of blade 16 for dispensing and cutting. Cutting bar 14 has a large vertical front face 14*a* (best shown in FIG. 4) extending axially from, below and generally parallel to blade 16. It will be understood that terms of spatial orientation such as "vertical", "up", "below", and "down" used herein are relative, based on a typical orientation of a tape dispenser as illustrated, and are not intended to be limiting.

A blade guard according to the present invention is illustrated at 20, slidably mounted for selective movement on cutting bar face 14*a* between blade covering and blade exposing positions relative to blade 16. FIG. 1 shows guard 20 in the up position, with its upper, curved end 22 overlying blade edge 16*a*. FIG. 2 shows guard 20 in its "down" position, exposing blade edge 16*a* so that tape dispensed across cutting bar 14 can be cut. While blade guard 20 is not illustrated in use on a tape dispenser 10 according to the disclosure of the U.S. patent application publication No. 2008/0067211, it will be understood by those skilled in the art that the blade guard according to the invention is not limited to use on the illustrated tape dispenser, but can be easily modified and applied to any tape dispenser having a cutting bar supporting a cutting element or blade at the upper end thereof and having a relatively large supporting face below and generally parallel to the blade.

Blade guard 20 is as wide as or wider than blade 16, so that upper edge 22 covers the entire cutting surface when in the up position of FIG. 1. Blade guard 20 can be flat or curved, preferably generally following the contour of the cutting bar face 14*a*. In the illustrated embodiment, the blade guard 20 is molded from a suitable plastic, although other materials and manufacturing methods are possible.

Figure 3:
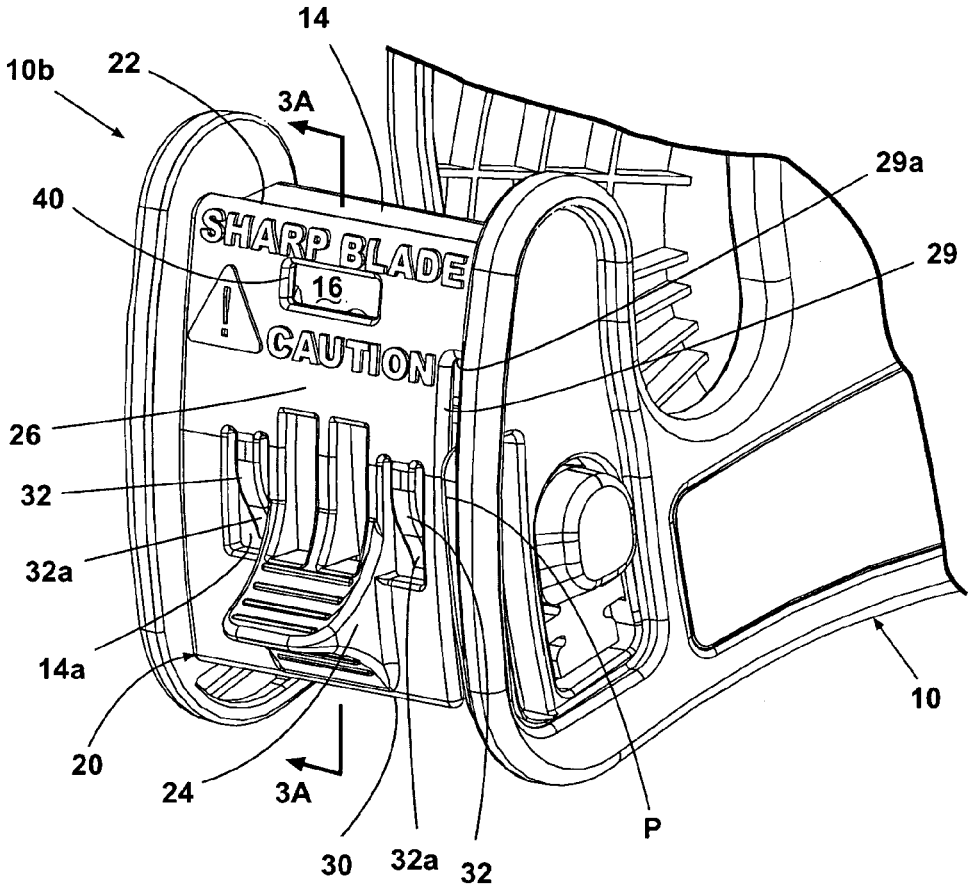
FIG. 3 is a detailed perspective view of the blade guard of FIG. 1, with the blade guard raised to cover the cutting blade.

Referring to FIG. 3, blade guard 20 has a protruding finger grip 24 at its lower end, away from the blade-covering upper edge 22 to keep fingers away from the blade during all stages of operation. Other shapes and styles of grip are possible, and could be as simple as a textured region on a lower portion of the front face 26 of the guard. Guard 20 has first and second side edges 28 and 29, and a lower end or edge 30. Right side edge 29 in the illustrated embodiment is relieved inwardly from upper edge 22, providing clearance and forming a shoulder 29*a* to accommodate a rotational dispenser mating portion P adjacent cutting bar face 14*a* that is part of the structure of the illustrated dispenser 10, but which is not necessary to the present invention. Blade guard 20 accordingly can vary in shape, and need not be a perfect match for the dimensions of the cutting bar face 14*a* on which it rides.

Blade guard 20 also includes at least one spring element 32, in the preferred, illustrated embodiment, a pair of cantilevered fingers 32 integrally formed in the face of the guard and projecting inwardly in resilient contact with the underlying cutting bar face 14*a* so that their free ends 32*a* maintain a tensioned sliding contact with the underlying cutting bar face 14*a*. The effect of spring elements 32 is to tend to push the lower end or edge 30 of the blade guard away from the cutting bar 14, thus tending to push the upper end or edge 22 of the blade guard toward the cutting bar 14 and blade 16.

Blade guard 20 is also shown with an optional aperture or "window" 40 formed in the upper end of the guard, located to give a visual indication of the blade guard's condition: blade 16 being visible through the aperture when the blade guard is up or "safe", covering the blade edge; cutting bar face 14*a* being visible through the aperture 40 when the blade guard 20 is down to expose the blade edge 16*a*. Since blade 16 will typically be a shiny, silver metal blade, and since the cutting bar face will typically be a differently-colored plastic material, the visual check is easily made. Even if the blade and cutting bar face are the same color or material, a contrasting indicator such as a sticker can be placed under the blade guard 20 to be selectively visible through aperture 40 depending on the blade guard's position.

Figure 2A:
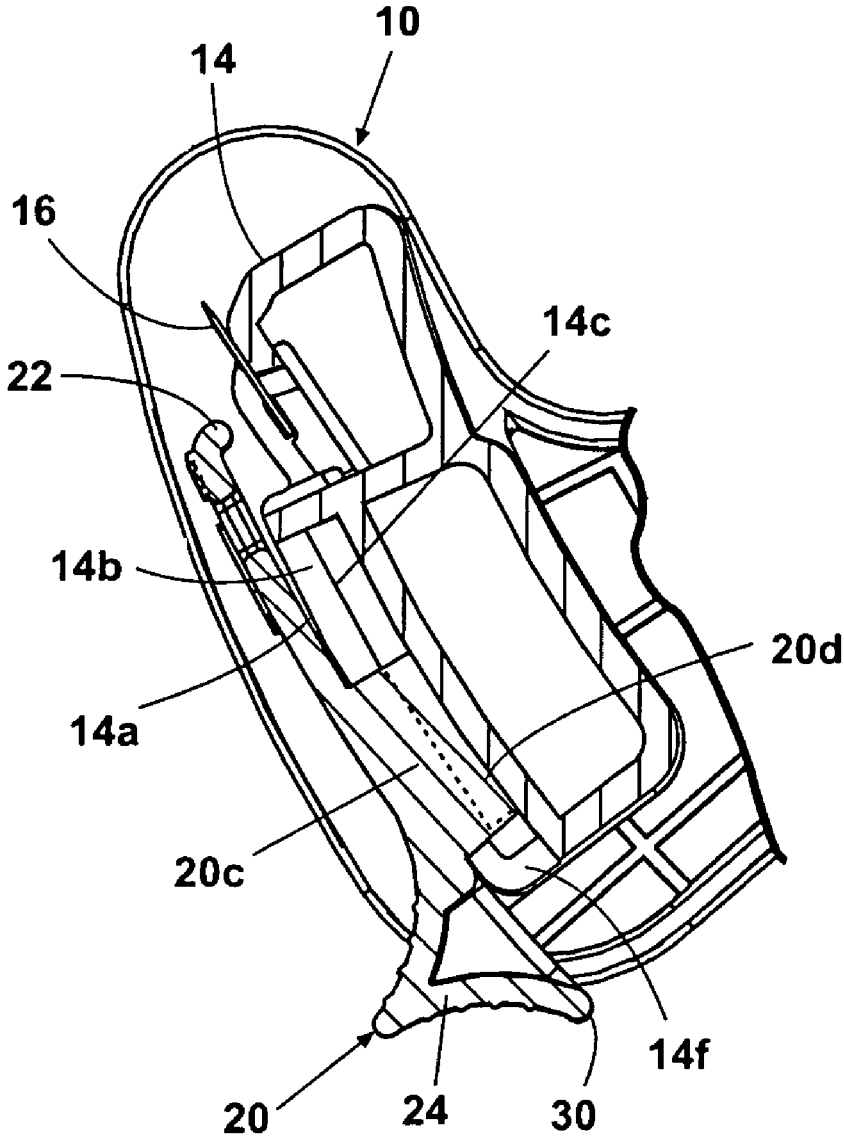
FIG. 2A is a side view taken along lines 3A-3A of FIG. 2 of the tape dispenser cutting bar and lowered blade guard of FIG. 2, showing the blade guard internal sliding connection to the cutting bar.
Figure 4:
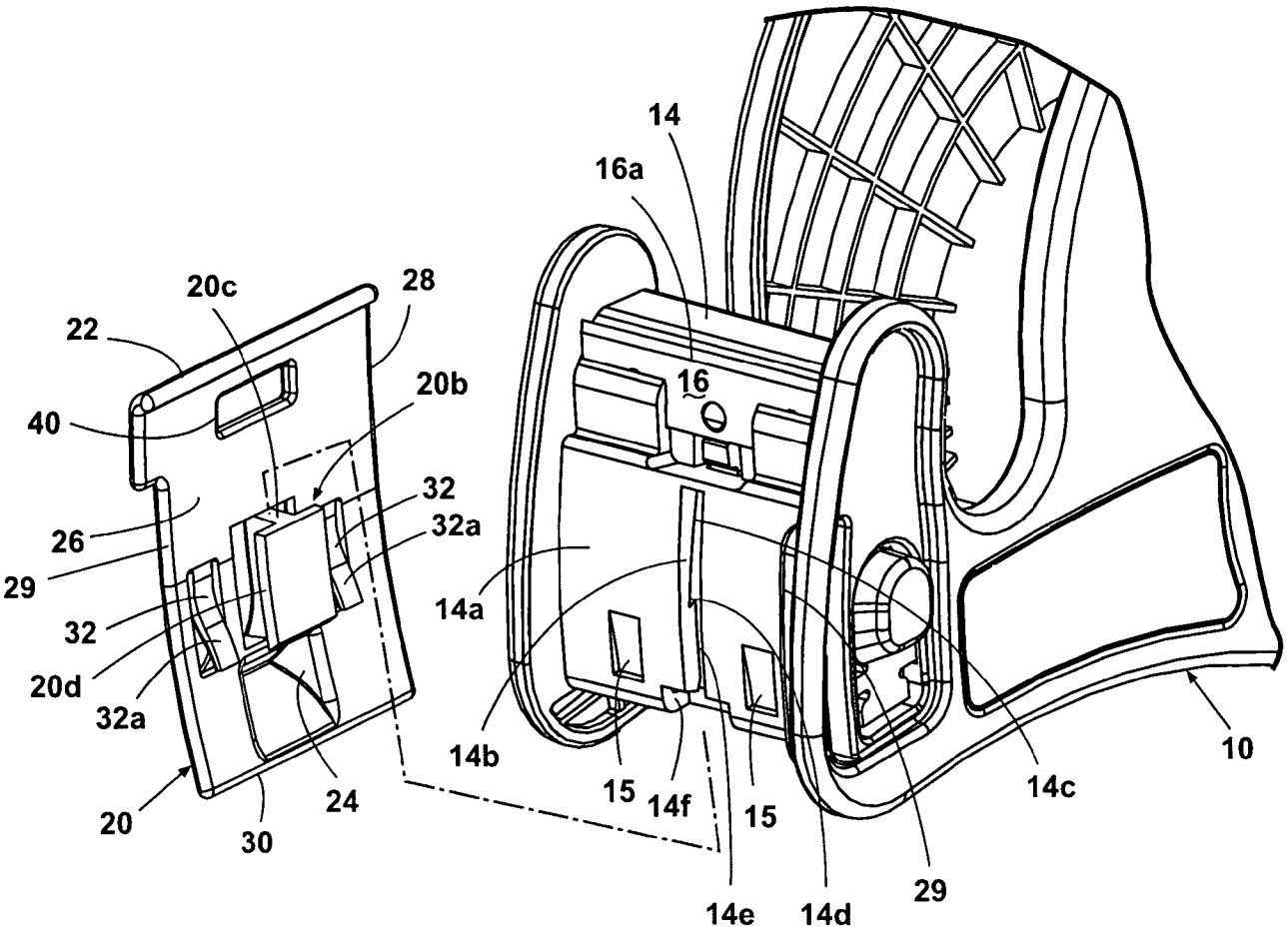
FIG. 4 is a partial perspective view, like FIG. 2, of the tape dispenser with the blade guard exploded from the dispenser to show the inside face of the blade guard and the cutting face bar.

Referring next to FIGS. 2A and 4, blade guard 20 is slidably mounted to the cutting bar 14 by a T shaped follower 20*b* that has a stem 20*c* and a pair of ears 20*d* and a vertical slot 14*b* that has a ramped surface 14*c*, a shoulder 14*d*, a raised surface 14*e* and a lateral opening 14*f*.

The follower 20*b* is inserted into the slot 14*b* through the opening 14*e* so that the stem 20*c* extends through the slot 14*b* and the ears 20*d* are retained behind the face 14*a*, in contact with the ramped surface 14*c* in the raised position with the bottom of the ears 20*d* above the shoulder 14*d* (FIG. 3A) or with the raised surface 14*e* in the lower position (FIG. 2A).

The track 14*b* and follower 20*b* will be referred to as "internal" in the illustrated embodiment, since the illustrated cutting bar has enough depth to have a hollow interior, but it will be understood that follower 20*b* can alternately ride on an exterior rear surface of a thinner and/or solid cutting bar. In either case, follower 20*b* is connected to the blade guard 20 through cutting bar face 14*a* by a suitable molded portion of the guard if the guard and follower are one molded piece, or by a suitable fastener or connector if the guard and follower are formed separately.

In the blade guard down position of FIG. 2A, internal guard follower 20*b* rests near the bottom of slot 14*b*, behind (to the right in the view of FIG. 2A) a raised surface 14*e*. The upper edge 22 of the blade guard 20 is below and in front of (to the left in the view of FIG. 2A) the exposed upper cutting edge of blade 16, in position for cutting tape passing across the top of bar 14. The lower end 30 of blade guard 20 is held or positioned inwardly toward the cutting bar 14, due to a combination of the relaxed state of spring elements 32, whose sliding contact ends 32*a* rest in detents 15 (FIG. 4) formed in the cutting bar face 14*a*, relieving the spring tension of spring elements 32; and of the engagement between the raised surface 14*e* and the ears 20*d*. The upper edge 22 of the guard is accordingly located in its most outward position away from the plane of blade 16.

Figure 3A:
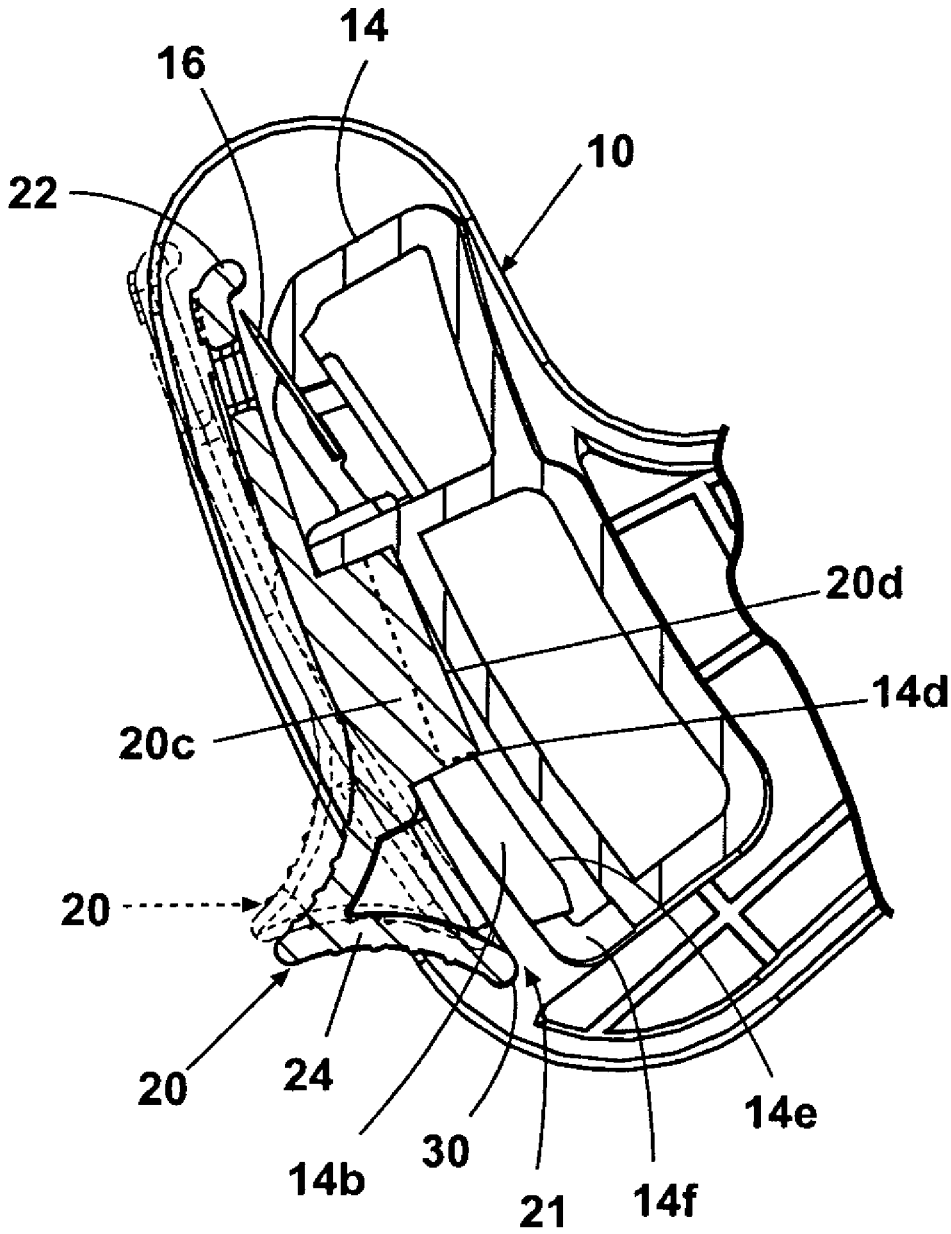
FIG. 3A is a side view like FIG. 2A of the tape dispenser cutting bar and raised blade guard of FIG. 3, showing the blade guard in a locked position in solid lines, and an unlocked position in phantom lines.

FIGS. 3 and 3A show blade guard 20 in the raised or blade covering position, covering the sharp edge of blade 16. Blade 16 is visible through aperture 40. Blade guard 20 is raised from the down position of FIGS. 2 and 2A to the blade-covering position of FIGS. 3 and 3A simply by sliding it upwardly on the cutting bar face, preferably using grip 24, with sufficient force to cam the flexible ends 32*a* of spring elements 32 out of the detents 15 on the cutting bar face 14*a*. As spring element ends 32*a* leave the detents and engage face

14*a*, the lower end 30 is biased outwardly under spring tension, causing internal follower ears 20*d* to snap into place above shelf 14*d* in slot 14*b*, and upper edge 22 of the guard to tilt inwardly to overlie and cover the upper edge of blade 16, as shown in solid lines in FIG. 3A. In this manner the blade guard is selectively retained in the blade covering position.

To lower blade guard 20 from the position of FIG. 3A, guard 20 is lifted upwardly and its lower end 30 pushed inwardly against the cutting bar face (preferably using grip 24), overcoming the force of spring elements 32 to rock the upper end 22 outwardly away from blade 16, as shown in phantom lines in FIG. 3A. Blade guard 20 is then simply slid back down the cutting bar face until it reaches the position shown in FIGS. 2 and 2A, at which point the spring elements 32 snap back into detents 15, thereby selectively retaining the blade guard in the blade exposing position.

It will be understood that the disclosed embodiments are representative of presently preferred forms of the invention, but are intended to be illustrative rather than definitive of the invention. Reasonable variation and modification are possible within the scope of the foregoing disclosure and drawings without departing from the spirit of the invention.

What is claimed is:

1. In a tape dispenser having a spool portion for dispensing a tape, a cutting portion; a cutting blade mounted on the cutting portion and adapted to cut tape fed from the spool portion, a blade guard slidably mounted on the cutting portion adjacent to the cutting blade for selective movement between blade-covering and blade-exposing positions, wherein the blade guard and the cutting portion are configured to selectively retain the blade guard in the blade covering and blade exposing positions;

the cutting portion includes a cutting bar supporting the cutting blade and with a face extending axially from the cutting blade and the blade guard is slidably mounted to the face of the cutting bar;

wherein the blade guard further includes at least one spring element in sliding tensioned contact with the cutting face, wherein the at least on spring element is positioned on the blade guard so that it tends to push a lower end of the blade guard away from the cutting bar face and to push an upper blade-covering end of the blade guard toward the cutter bar face when the blade guard is in the blade covering position;

wherein the cutting bar face has a slot and the blade guard comprises a T-shaped follower with a stem that extends through the slot and ears that are retained on a rear surface of the cutting bar behind the face for sliding movement of the blade guard on the cutting bar.

2. The tape dispenser of claim 1 wherein the blade guard further comprises a grip for moving the blade guard between the blade-covering and blade-exposing positions.

3. The tape dispenser of claim 2 wherein the grip is positioned at a lower end of the blade guard.

4. The tape dispenser of claim 1 wherein the cutting bar face includes a detent for receiving and relieving the at least one spring element when the blade guard is in the blade-exposing position.

5. The tape dispenser of claim 4 and further comprising a releasable interlock between the blade guard and the cutting bar for releasably maintaining the blade guard in the blade-covering position.

6. The tape dispenser of claim 5 wherein the releasable lock comprises a shoulder on the rear surface of the cutting bar below and in registry with the ears on the blade guard follower when the blade guard is in the blade-covering position.

7. A tape dispenser adapted to rotatably house a roll of tape, comprising:

two unitary sidewalls, a top wall portion extending axially between the sidewalls and connecting the sidewalls above the outer diameter of a roll of tape contained in the dispenser;

a spool support extending axially between the sidewalls and connecting the sidewalls through a spool portion of a roll of tape contained in the dispenser; and a cutting bar extending axially between the sidewalls and connecting the sidewalls together at a forward end of the dispenser, the cutting bar mounting a cutting element for cutting tape and forming a tape retainer surface adjacent to the cutting element for adhesively securing a leading cut end of tape from a roll of tape contained in the dispenser subsequent to severing a leading portion of the tape from the cut end:

the cutting bar being spaced circumferentially from a forward end of the top wall portion to define a tape-feed opening between the top wall portion and the cutting bar;

wherein the dispenser is radially split into two axially registering and rotationally mating halves that have rotationally mating locking structures on each of the top wall portion, the spool support, and the cutting bar that releasably interlock the mating halves together as the mating halves are rotated relative to each other.

8. The tape dispenser of claim 7 and further comprising a blade guard slidably mounted on the cutting bar adjacent to the cutting blade for selective movement between blade-covering and blade-exposing positions.

9. The tape dispenser of claim 7 and further comprising a blade guard slidably mounted on the cutting bar adjacent to the cutting blade for selective movement between blade-covering and blade-exposing positions, and wherein the blade guard further includes at least one spring element in sliding tensioned contact with the cutting bar.

10. The tape dispenser of claim 9 wherein blade guard has a blade covering end that covers the cutting blade when the blade guard in in the blade covering position and the at least one spring element is positioned to bias the blade-covering end of the blade guard toward the cutting blade when the blade guard is in the blade covering position.

* * * * *